US005230599A

United States Patent [19]

Orr

[11] Patent Number: 5,230,599

[45] Date of Patent: Jul. 27, 1993

[54] TRAILER CHASSIS HANDLING APPARATUS

[76] Inventor: Bobby J. Orr, Rte. 1, Box 239, Greenfield, Tenn. 38230

[21] Appl. No.: 766,842

[22] Filed: Sep. 27, 1991

[51] Int. Cl.[5] ..... B66F 9/18

[52] U.S. Cl. ..... 414/607; 414/621; 414/626; 414/783; 212/221; 212/243; 294/103.1; 294/119.1; 294/81.62; 294/81.4; 294/81.2

[58] Field of Search ..... 414/607, 608, 791.3, 414/791.4, 792.9, 618, 619, 620, 621, 626, 754, 758, 763, 783, 785; 212/220, 221, 242, 243; 294/103.1, 81.4, 119.1, 81.62, 81.2

[56] References Cited

U.S. PATENT DOCUMENTS

| | | | |
|---|---|---|---|
| 2,827,184 | 3/1958 | Mueller | 414/607 X |
| 2,971,662 | 2/1961 | Dunham . | |
| 3,100,123 | 8/1963 | Schmidt | 414/626 X |
| 3,506,148 | 4/1970 | Vik . | |
| 4,437,807 | 3/1984 | Perrott | 414/620 |
| 4,583,902 | 4/1986 | Riley | 414/261 |
| 4,600,350 | 7/1986 | Matthewson et al. | 414/267 |
| 4,664,576 | 5/1987 | Coe | 414/55 |
| 4,952,118 | 8/1990 | Macmillan | 414/788 |
| 5,096,365 | 3/1992 | Ford | 414/621 X |

FOREIGN PATENT DOCUMENTS

| | | | |
|---|---|---|---|
| 2427992 | 2/1980 | France | 414/783 |
| 1271815 | 11/1985 | U.S.S.R. | 414/621 |

*Primary Examiner*—Frank E. Werner
*Attorney, Agent, or Firm*—Walker, McKenzie & Walker

[57] ABSTRACT

A rotator including a base frame for being attached to a lift mechanism; a rotating frame; a first latch member attached to the rotating frame; a second latch member attached to the rotating frame a spaced distance from the first latch member for coacting with the first latch member to securely attach a trailer chassis to the rotating frame; and axle structure rotatably attaching the rotating frame and the base frame to one another for allowing the rotating frame to rotate between a first position and a second position to rotate the trailer chassis between an upright position and an inverted position about an axis parallel to the longitudinal axis of the trailer chassis.

13 Claims, 5 Drawing Sheets 11
17
21
23
19
59
60
63
61
51
47
55
33
49
31
37
41
35
43
65
67
75
73
72
13
15

11
23
19
17
21
59
60
63
51
65
75
67
73
72
13
15
47
55
33
49
31
41
35
43

11
23
19
17
21
59
63
60
51
75
65
67
13
41
15
47
55
33
49
31
37
35
43

65
67
23
19
11
47
49
33
31
41
13
35
43
15
17
21
63
59
60
51

TRAILER CHASSIS HANDLING APPARATUS

BACKGROUND OF THE INVENTION

1. Field of the Invention

The present invention relates, in general, to an apparatus for allowing a trailer chassis or the like to be lifted, rotated and handled.

2. Description of the Related Art

A preliminary patentability search conducted in class 414, subclasses 620 and 678 produced the following patents which may be relevant to the present invention: Dunham, U.S. Pat. No. 2,971,662, issued Feb. 14, 1961; Vik, U.S. Pat. No. 3,506,148, issued Apr. 14, 1970; Perrott, U.S. Pat. No. 4,437,807, issued Mar. 20, 1984; Riley, U.S. Pat. No. 4,583,902, issued Apr. 22, 1986; Matthewson et al., U.S. Pat. No. 4,600,350, issued Jul. 15, 1986; Coe, U.S. Pat. No. 4,664,576, issued May 12, 1987; and Macmillan, U.S. Pat. No. 4,952,118, issued Aug. 28, 1990.

The Dunham and Vik patents disclose attachments for industrial lift trucks and the like which allow open-top boxes or drums, such as fruit boxes and scrap metal drums, to be picked up, transported to a selected location, and rotated to dump their contents. The Vik dumper is designed so that gravity will cause a filled drum to rotate to dump its contents, and includes a latch mechanism to lock the drum in an upright position until released and a spring to return an empty drum back to the upright position.

The Perrott, Riley, Matthewson et al., Coe and Macmillan patents relate generally to apparatuses and methods for lifting, transporting and storing wheeled container trailer chassis after removal of a detachable cargo container, etc.

Perrott discloses an attachment for a lift truck which allows a trailer chassis to be gripped by a clamping mechanism, raised above the ground and pivoted about a transverse axis from its normal horizontal position to a vertical position for transport to a multiple storage unit.

Riley discloses an attachment for the three point lift suspension of a tractor or the elevating mechanism of a lift truck which allows a trailer chassis to be gripped by a clamping mechanism, elevated above the ground and pivoted about a transverse axis from its normal horizontal position to a vertical position for transport to a multiple storage unit where it is deposited and retained in the vertical position.

Matthewson et al. discloses an attachment for a lift truck which allows a container trailer chassis to be gripped by a clamping means, lifted, and rotated around a transverse axis about 90 degrees to a substantially upright position or, alternatively, 180 degrees to an upside-down position.

Coe discloses an apparatus for being attached to the front end of a fork lift truck or the like which allows a trailer chassis to be gripped, elevated, and rotated around its longitudinal axis. The Coe apparatus use two large hydraulic clamps to grip the side members (I-beams) of the trailer chassis frame, gripping both I-beams in a normally vertical plane (parallel to the web of the I-beams).

Macmillan discloses an apparatus for being attached to an overhead crane, forklift truck, or the like which allows a trailer chassis to be gripped, elevated, and transported to a storage rack for storage in a stacked, right-side up, horizontal arrangement.

None of the above patents disclose or suggest the present invention. More specifically, none of the above patents disclose or suggest a rotator including a base frame for being attached to a lift mechanism; a rotating frame; a first latch member attached to the rotating frame; a second latch member attached to the rotating frame a spaced distance from the first latch member for coacting with the first latch member to securely attach a trailer chassis to the rotating frame; and axle means rotatably attaching the rotating frame and the base frame to one another for allowing the rotating frame to rotate between a first position and a second position to rotate the trailer chassis between an upright position and an inverted position about an axis parallel to the longitudinal axis of the trailer chassis.

SUMMARY OF THE INVENTION

The present invention is directed toward providing an improved apparatus for lifting, transporting and rotating wheeled container trailer chassis. Wheeled container trailer chassis (which are almost identical to common flat-bed semi-trailers except that the trailer chassis have no bed) are used to transport large, detachable shipping containers (often referred to as Standardized Shipping Containers) and their contents by road. The containers are detached from the trailer chassis for shipment by rail or ship. These trailer chassis, when not in use moving a container, must be stored or transported elsewhere to transport another container. Shipping individual trailer chassis is prohibitively expensive. Therefore, methods of bundling up to four units together have been devised to reduce this cost. A bundle of trailer chassis typically consists of two upright and two inverted trailer chassis with every other one inverted and facing opposite directions. Thus, a bundle may include a first right-side up trailer chassis, a first upside-down trailer chassis positioned on top of the first right-side up trailer chassis, a second right-side up trailer chassis positioned on top of the first upside-down trailer chassis, and a second upside-down trailer chassis on top of the second right-side up trailer chassis. Such a bundle may then be shipped either by rail, ship, or over the road on another trailer chassis.

The operation of building such a trailer chassis bundle has heretofore been a difficult, time-consuming, and sometimes dangerous procedure which, in itself, is costly. Many operators merely use a large fork lift truck to tip a trailer chassis to the point where gravity causes it to turn over and fall to the ground. This is, of course, somewhat hazardous and many times causes damage to the trailer chassis. The turned-over trailer chassis is then lifted with the fork lift, by placing the forks at or as near the center of gravity as the operator can guess. The operator then carries the trailer chassis on the forks to the point where the trailer chassis is lifted and placed on the stack.

At shipping ports and railheads, it is not uncommon to have hundreds, or even thousands of empty container trailer chassis parked on the ground awaiting their turn to be loaded with a container and moved out. Storage space for empty trailer chassis is often cramped at such ports because of the value of the land, etc. In this situation each acre of ground (sometimes valued at more than a million dollars) will accommodate only 120 to 130 trailer chassis. However, by building bundles of empty container trailer chassis, as many as twelve empty container trailer chassis can be stacked in the space normally required to park one trailer chassis.

The rotator of the present invention includes, in general, a base frame for being attached to a lift mechanism; a rotating frame; a first latch member attached to the rotating frame; a second latch member attached to the rotating frame a spaced distance from the first latch member for coacting with the first latch member to securely attach a trailer chassis to the rotating frame; and axle means rotatably attaching the rotating frame and the base frame to one another for allowing the rotating frame to rotate between a first position and a second position to rotate the trailer chassis between an upright position and an inverted position about an axis parallel to the longitudinal axis of the trailer chassis.

One object of the present invention is to provide safe, inexpensive, damage free trailer chassis rotation during the bundling and stacking process for both storage and shipping of such trailer chassis.

Another object of the present invention is to provide a trailer chassis rotator which will mount onto the blades of a wide variety of forklift trucks or onto overhead cranes, etc., which will handle a broad range of container trailer chassis (e.g., 20 foot to 40 foot and longer container trailer chassis with frame widths between 40 and 44 inches, etc.), and which does not require such equipment to be dedicated to the chassis rotator.

Another object of the present invention is provide such a trailer chassis rotator which may be hydraulically operated or mechanically operated.

Another object of the present invention is to provide such a trailer chassis rotator which presents the terminal, depot or trailer chassis pool operator with the capability to handle trailer chassis both safely and damage free with a single operator from the cab of a fork lift truck or crane, etc.

Another object of the present invention is to provide such a trailer chassis rotator that will rotate trailer chassis from the upright position to the inverted position and from the inverted position to the upright position, and will handle trailer chassis during stacking and unstacking operations.

Another object of the present invention is provide a safe trailer chassis rotator that eliminates the need for a person to work in front of the fork lift truck or under a chassis when it is being lifted.

Another object of the present invention is to provide a trailer chassis rotator that is simple in design and operation to yield a very cost-effective unit with low maintenance requirements and a long trouble-free life.

DESCRIPTION OF THE PREFERRED EMBODIMENT

Figure 1:
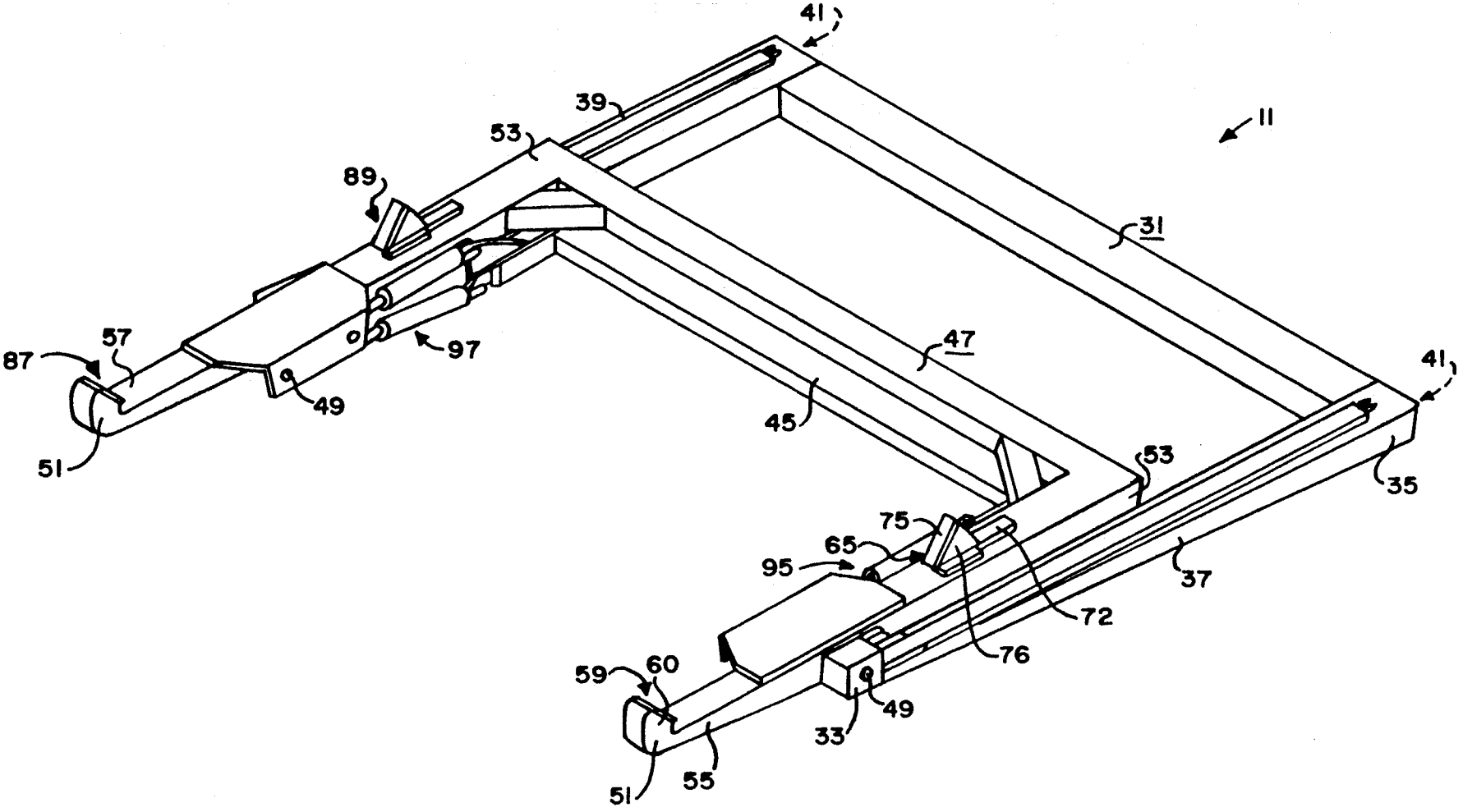
FIG. 1 is a perspective view of a first embodiment of the rotator of the present invention.

A first preferred embodiment of the rotator of the present invention is shown in FIGS. 1–10 and identified by the numeral 11. The rotator 11 is designed to be attached to the lift mechanism 13 of a typical fork lift truck 15 or the like for lifting, transporting, and rotating a wheeled container trailer chassis 17 between a normal, right-side up position and an inverted, upside-down position about an axis parallel to the longitudinal axis of the trailer chassis 17. The trailer chassis 17 is of any typical construction used to transport large, detachable shipping containers and their contents by road as will now be apparent to those skilled in the art. The trailer chassis 17 includes an elongated frame formed by a pair of spaced apart side frame members 19 fixedly joined together by one or more cross members 21. Each side frame member 19 has an outwardly extending flange 23 at the upper and lower edge thereof. As shown more clearly in FIG. 11 with respect to a second preferred embodiment of the rotator of the present invention, the trailer chassis 17 typically includes a tandem axle dual wheel assembly 25 attached to the frame for supporting one end thereof when the trailer chassis 17 is in a normal right-side up position, a pair of laterally spaced, vertically adjustable landing gear legs or jack assemblies 27 attached to the frame for supporting the other end thereof when the trailer chassis 17 is detached from a tractor-truck and in a normal right-side up position on a support surface, and a hitch assembly 29 for allowing the trailer chassis 17 to be coupled to a typical tractor-truck or the like.

The rotator 11 includes a base frame 31 for being attached to the lift mechanism 13. The base frame 31 preferably has a first end 33, a second end 35, a first side 37 extending between the first and second ends 33, 35, and a second side 39 extending between the first and second ends 33, 35. The second end 35 of the base frame 31 preferably includes means for being attached to the lift mechanism 13 of the fork lift truck 15. More specifically, the base frame 31 may have a pair of spaced apart apertures 41 therein extending generally from the second end 35 thereof along each first and second side 37, 39 for allowing the forks 43 of the lift mechanism 13 of the fork lift truck 15 to be inserted thereinto to thereby attach the base frame 31 to the lift mechanism 13 as will now be apparent to those skilled in the art. One or more safety chain assemblies (not shown) are preferably provided to loosely secure the rotator 11 to the fork lift truck 15 while preventing accidental separation of the rotator 11 from the fork lift truck 15 as will now be apparent to those skilled in the art. The specific design, size and construction of the base frame 31 may vary as will now be apparent to those skilled in the art. The base frame 31 is preferably constructed primarily out of rigid metal structural members and the like welded or otherwise secured together to form a substantially rigid, open-frame structure with a pair of spaced apart, elongated structural side members forming the sides 37, 39, with an elongated structural back member extending between one end of each side member and forming the second end 35, with the ends of each side member opposite the back member forming the first end 33, and with an elongated structural cross member 45 extending between each side member substantially midway between the ends thereof to strengthen the base frame 31, etc.

The rotator 11 includes a rotating frame 47 and axle means 49 for rotatably attaching the rotating frame 47 to the base frame 31. The rotating frame 47 preferably has a first end 51, a second end 53, a first side 55 extending between the first and second ends 51, 53 thereof, and a second side 57 extending between the first and second ends 51, 53 thereof. The specific design, size and construction of the rotating frame 47 may vary as will now be apparent to those skilled in the art. The rotating frame 4 is preferably constructed primarily out of rigid metal structural members and the like welded or otherwise secured together to form a substantially rigid, open-frame structure with a pair of spaced apart, elongated structural side members forming the sides 55, 57, with an elongated structural back member extending between one end of each side member and forming the second end 53, and with the ends of each side member opposite the back member forming the first end 51. The axle means 49 may include spherical ball-type, self-aligning rotational bearing means for joining the elongated structural side members that form the sides 37, 39 of the base frame 31 to the elongated structural side members that form the sides 55, 57 of the rotating frame 47 to one another at a point adjacent the first end 33 of the base frame 31 and a point between the first and second ends 51, 53 of the rotating frame 47 as will now be apparent to those skilled in the art. The spherical self-aligning rotation bearings accommodate misalignment and deflection caused by an unbalanced chassis 17 during rotation, thus preventing excessive stresses from shortening the life of the frame members or damaging a chassis 17.

The rotator 11 includes a first latch member 59 fixedly attached to the rotating frame 47. The first latch member 59 is preferably fixedly attached to the first side 55 of the rotating frame 47 adjacent the first end 51 thereof. The specific design, size and construction of the first latch member 59 may vary as will now be apparent to those skilled in the art. The first latch member 59 preferably consists of a rigid hook-like structure 60 that may be formed, at least in part, as an integral part of the elongated structural side member that forms the first side 55 of the rotating frame 47 adjacent the first end 51. The hook-like structure 60 provides a jaw portion 61 that receives a portion of one of the outwardly extending flanges 23 of one of the side frame members 19 of the trailer chassis 17 as shown in FIGS. 2–8. The opening of the jaw portion 61 allows ample clearance for aligning the latch member 59 with the respective flange 23 of the chassis 17, yet does not allow so much clearance as to allow the chassis 17 to move or come loose during rotation as will hereinafter become apparent. The jaw portion 61 is preferably wide at the point where it contacts the flange 23 of the chassis 17 to keep contact stresses low at this point in order to prevent damage to the chassis 17. The outer face of the hook-like structure 60 is preferably provided with a sloped cam surface 63 for use in properly positioning the first latch member 59 as will hereinafter become apparent.

Figure 2:
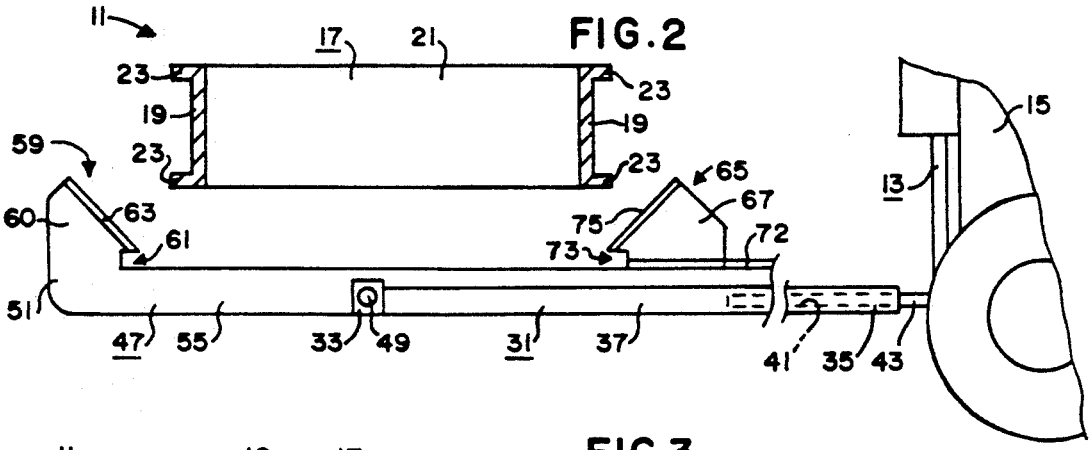
FIG. 2 is a somewhat diagrammatic side elevation view of the rotator of FIG. 1 with portions thereof broken away for clarity, shown in combination with a portion of a fork lift truck and a section of a trailer chassis with the trailer chassis in an upright position.
Figure 3:
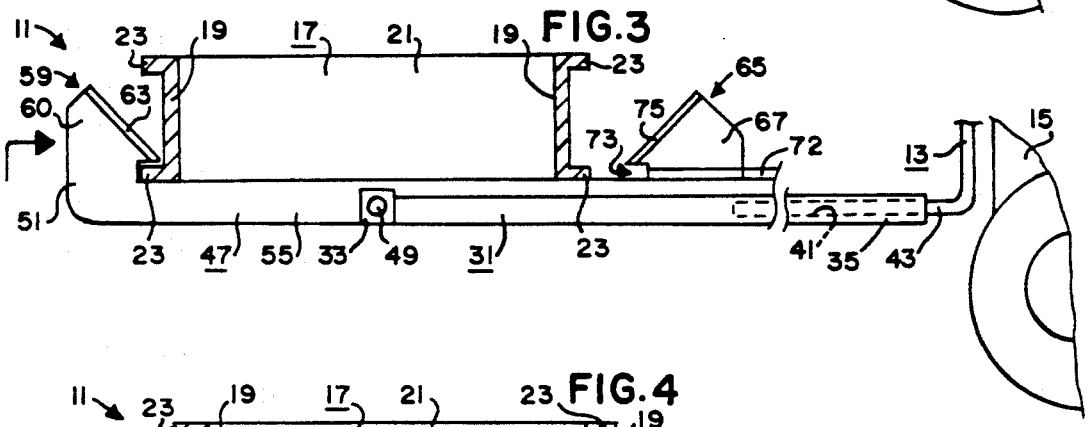
FIG. 3 is a side elevational view similar to FIG. 2 but with one side of the trailer chassis coupled to the rotator.
Figure 4:
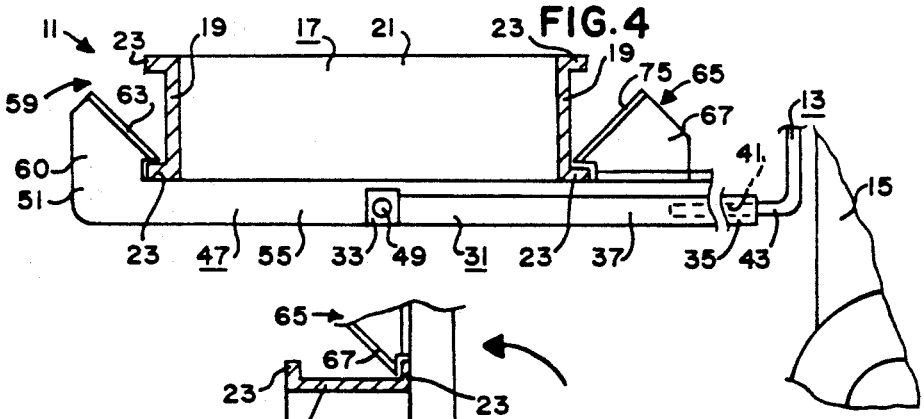
FIG. 4 is a side elevational view similar to FIG. 3 but with both sides of the trailer chassis coupled to the rotator.
Figure 5:
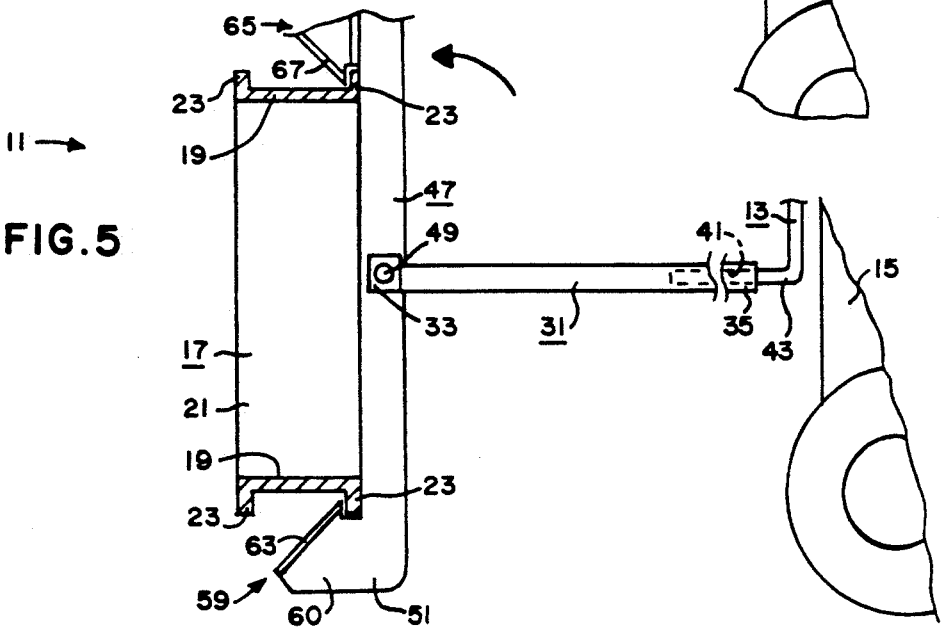
FIG. 5 is a side elevational view similar to FIG. 4 but with the trailer chassis rotated 90 degrees.
Figure 6:
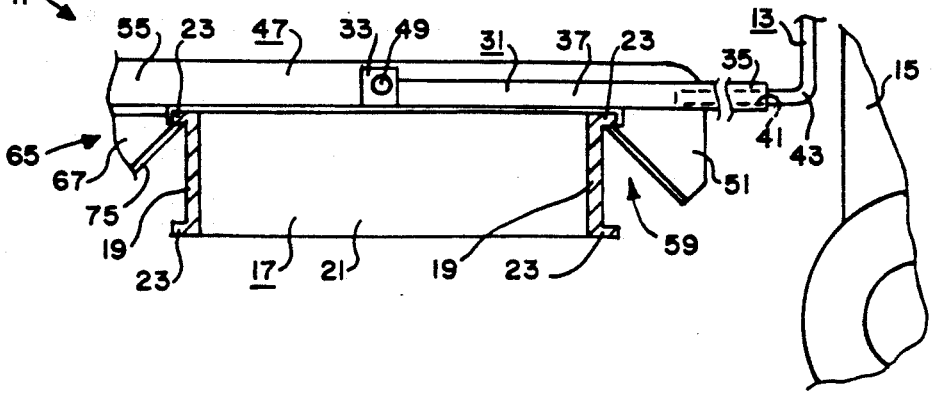
FIG. 6 is a side elevational view similar to FIG. 4 but with the trailer chassis rotated 180 degrees to an inverted position.

The rotator 11 includes a second latch member 65 movably attached to the first side 55 of the rotating frame 47 a spaced distance from the first latch member 59. The second latch member 65 is movable between an opened position as shown in FIGS. 2 and 3, and a closed position as shown in FIGS. 4, 5 and 6 for securely clamping the trailer chassis 17 to the rotating frame 47 between the first and second latch members 59, 65 when the second latch member 65 is in the closed position. The specific design, size and construction of the second latch member 65 may vary as will now be apparent to those skilled in the art. The second latch member 65 preferably includes a rigid hook-like structure 67 that is slidably mounted on the elongated structural side member that forms the first side 55 of the rotating frame 47 between the first and second ends 51, 53. More specifically, the hook-like structure 67 may be slidably mounted in a slot 69 in the top of the elongated structural side member that forms the first side 55 of the rotating frame 47. Grooves 71 may be provided in the sides of the hook-like structure 67 to guide the hook-like structure 67 back and forth along the sides of the slot 69 as will now be apparent to those skilled in the art. A tail-like member 72 may be provided on the hook-like structure to cover the slot when the latch member 65 is in the closed position. The hook-like structure 67 provides a jaw portion 73 that receives a portion of one of the outwardly extending flanges 23 of one of the side frame members 19 of the trailer chassis 17 as shown in FIGS. 4, 5 and 6. The opening of the jaw portion 73 allows ample clearance for aligning the latch member 65 with the respective flange 23 of the chassis 17, yet does not allow so much clearance as to allow the chassis 17 to move or come loose during rotation as will hereinafter become apparent. The jaw portion 73 is preferably wide at the point where it contacts the flange 23 of the chassis 17 to keep contact stresses low at this point in order to prevent damage to the chassis 17. The outer face of the hook-like structure 67 is preferably provided with a sloped cam surface 75 for use in properly positioning the second latch member 65 as will hereinafter become apparent.

The rotator 11 preferably includes latch control means 77 for moving the second latch member 65 between the opened and closed positions. The latch control means 77 preferably includes a typical hydraulic cylinder having a piston cylinder 79 attached to the elongated structural side member that forms the first side 55 of the rotating frame 47 by an ear 81 or the like, and having a piston rod 83 attached to the second latch member 65 by an ear 85 or the like. The hydraulic cylinder may be coupled to the hydraulic system of the fork lift truck 15 by appropriate hoses, valves, and the like as will now be apparent to those skilled in the art. Fluid for the head end of the piston cylinder 79 preferably travels to a rotary fitting on one end of the axle means 49, then through a passage along the centerline of and part way through that end of the axle means 49, and then through a side port to the head end of piston cylinder 79. Fluid for the rod end of the piston cylinder 79 preferably travels to a second rotary fitting on the opposite end of the axle means 49, then through a passage along the centerline of and part way through that end of the axle means 49, and then to a side port and to the rod end of the piston cylinder 79. However, it should be noted that the rotator 11 could include a self-contained, on board power unit for controlling the hydraulic piston, etc.

The rotator 11 preferably includes a third latch member 87 fixedly attached to the second side 57 of the rotating frame 47 adjacent the first end 51 thereof. The third latch member 87 is preferably a mirror image of the first latch member 59 and the above description of the first latch member 59 should be consulted for a complete understanding of the construction and operation of the third latch member 87.

The rotator 11 preferably includes a fourth latch member 89 movably attached to the second side 57 of the rotating frame 47 a spaced distance from the third latch member 87. The fourth latch member 89 is preferably a mirror image of the second latch member 65 and the above description of the second latch member 65 should be consulted for a complete understanding of the construction and operation of the fourth latch member 89.

The rotator 11 preferably includes a fourth latch member latch control means for moving the fourth latch member 89 between the opened and closed positions. The fourth latch member latch control means is preferably a mirror image of the latch control means 77 associated with the second latch member 65 and the above description of the latch control means 77 should be consulted for a complete understanding of the construction and operation of the fourth latch member latch control means. Hydraulic fluid for the head and rod ends of the piston cylinder of the fourth latch member latch control means preferably travels through cross-over lines from the lines to the respective ends of the piston cylinder 79 of the latch control means 77 as will now be apparent to those skilled in the art.

Figure 7:
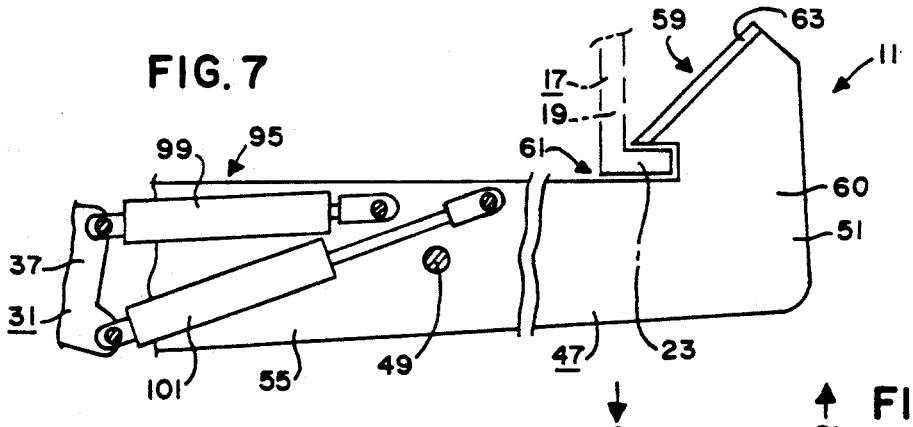
FIG. 7 is a somewhat diagrammatic sectional view of a portion of the rotator of FIG. 1 with portions thereof broken away for clarity and with a portion of a trailer chassis shown in broken lines.
Figure 8:
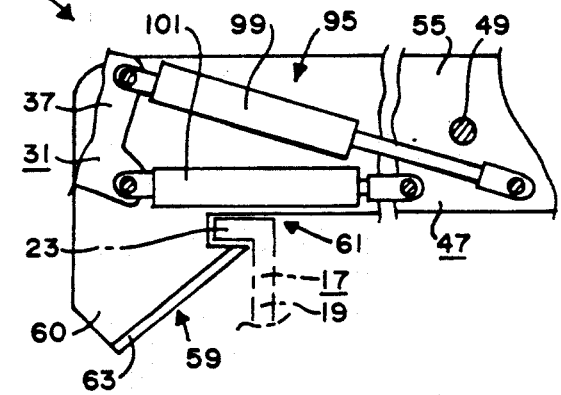
FIG. 8 is a sectional view similar to FIG. 7 but with the trailer chassis rotated 180 degrees.
Figure 10:
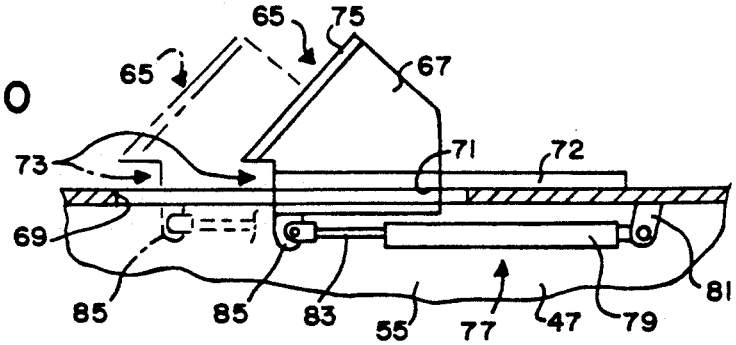
FIG. 10 is a somewhat diagrammatic sectional view of a portion of the rotator of FIG. 1 showing a portion thereof in a moved position in broken lines.

The rotator 11 preferably includes rotating control means for rotating the rotating frame 47 about the axle means 49 between the first and second positions. The rotating control means could include a pair of gear sectors, one of which is activated by a hydraulic cylinder or linear mechanical actuator, with one of the gear sectors mounted to the base frame 31 and with the other gear sector mounted to the rotating frame 47 so that rotation of one gear sector by a hydraulic cylinder or linear mechanical actuator will cause the other gear sector to rotate and, in turn, cause the rotating frame 47 to rotate about the axle means 49. However, the rotating control means preferably simply includes hydraulic cylinder means extending between the base frame 31 and the rotating frame 47. More specifically, the rotating control means preferably includes a first rotating control means 95 extending between the first side 37 of the base frame 31 and the first side 55 of the rotating frame 47, and a second rotating control means 97 extending between the second side 39 of the base frame 31 and the second side 57 of the rotating frame 47. The first rotating control means 95 preferably includes a first hydraulic cylinder 99 and a second hydraulic cylinder 101 both anchored at their rod ends to a portion of the first side 55 of the rotating frame 47 adjacent the axle means 49 and anchored at their other end to a portion of the first side 37 of the base frame 31 as clearly shown in FIGS. 7 and 8. The second rotating control means 97 is a mirror image of the first rotating control means 95 and includes first and second hydraulic cylinders. Rotation of the rotating frame 47 is thus accomplished by the four hydraulic cylinders of the first and second rotating control means 95, 97 with the cylinders working in pairs through lever arms spaced so as to allow approximately 180 degrees of rotation along the longitudinal axis of the chassis 17. One cylinder of each rotating control means 95, 97 pushes against the rotating frame 47 while the other cylinder of each rotating control means 95, 97 pulls the rotating frame 47 at the same time. Thus, the sum of the forces of all four cylinders provides the torque needed to rotate the rotating frame 47 and chassis 17, as will now be apparent to those skilled in the art. While the four cylinders operate in pairs with two pushing and two pulling during most of the 180 degree rotation cycle, due to the geometry of the rotational cylinder and linkage system as shown in FIGS. 7 and 8, there is a point at the beginning and end of the 180 degree cycle where two of the cylinders actually oppose the forces of the other two cylinders. This is not a desired feature, but does not create a problem because it occurs only during a few degrees of rotation at the beginning and end of the 180 degree rotation cycle where the force and torque requirements are lowest, because the opposing forces are quite small in relation to the rotational forces because of the differential piston areas of the two hydraulic cylinders (i.e., the cylinders initiating rotation is generating their force from their head or large diameter end whereas the opposing cylinders are generating their force from their rod or small diameter end so that the net force is still more than adequate to cause rotation to occur, and because the effective length of the bellcrank of the cylinder initiating rotation is much longer than that of the opposing cylinder during this portion of the rotation cycle). When the chassis 17 is rotated about its longitudinal center of gravity, the torque required is very low. The torque curve generated by these four cylinders and their geometry starts low at each end of the rotational arc and reaches a peak at the half-way point to match the curve required to rotate the chassis 17 as will now be apparent to those skilled in the art. Rubber stops or bumpers or the like may be provided between the base frame 31 and rotating frame 47 to cushion the stop at both ends of the rotational travel of the rotating frame 47 and to help prevent damage to the frame members and chassis 17.

The hydraulic cylinders of the latch control means and rotating control means may be coupled to the hydraulic system of the fork lift truck 15 by appropriate hydraulic lines and valves, etc., to allow the operator of the fork lift truck 15 to control the operation thereof as will now be apparent to those skilled in the art. However, the rotator 11 may be provided with an optional on-board power unit to provide the necessary hydraulic power, etc., as will now be apparent to those skilled in the art. Further, remote radio control could be incorporated to make the unit flexible and adaptable to a wide variety of circumstances.

Figure 9:
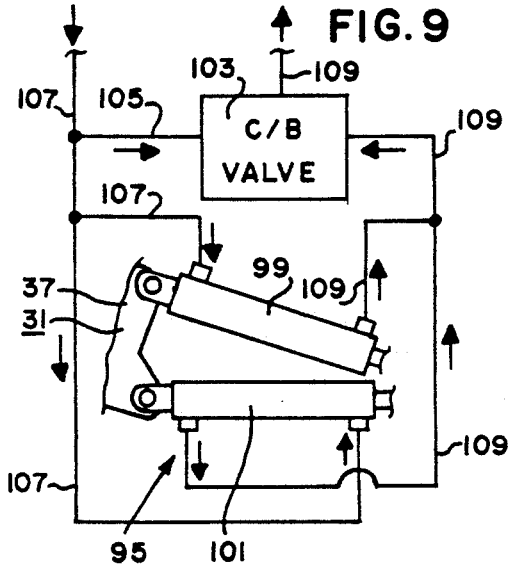
FIG. 9 is a schematic diagram of a portion of the hydraulic circuit of the rotator of FIG. 1.

A hydraulic counter-balance valve 103 is preferably incorporated in the hydraulic circuit controlling the rotating control means to prevent weight of the rotating frame 47 and chassis 17 from over-running the hydraulic cylinders of the rotating control means during rotation of an inverted chassis 17 to the upright position when the chassis 17 is gripped from the top side of its frame. Without such a counter-balance valve, rotation could be much too fast and could cause damage to both the chassis 17 and the rotator 11 when the rotating frame 47 reaches the end of its travel. As shown in FIG. 9, the counter-balance valve 103 is connected by a pilot line 105 to the oil supply line 107 extending from the hydraulic source to the hydraulic cylinders 99, 101 and is connected to the oil return line 109 extending from the hydraulic cylinders 99, 101. The counter-balance valve will restrict the flow of oil in the return line 109 to prevent the load from moving too fast.

Replaceable wear bars are preferably incorporated into the sliding latches for economical rebuild when the rotator 11 becomes excessively worn.

Operation of the rotator 11 is quite simple. With the rotator 11 properly mounted on the fork lift truck 15, the operator merely drives up to the chassis 17 to be inverted and positions the latch members of the rotating frame 47 beneath the side frame members 19 of the chassis 17 as shown in FIG. 2. Next, the lift mechanism 13 is activated to raise the rotating frame 47 to the bottom of the chassis 17 as shown in FIG. 3. The latch control means 77, 91 are then activated to secure the chassis 17 to the rotating frame 47 as shown in FIG. 4. The lift mechanism 13 can then be activated to lift the chassis 17 above the supporting surface and the rotating controls means 95, 97 activated to rotate the rotating frame 47 and the chassis 17 as shown in FIGS. 5 and 6. To rotate an inverted chassis 17 or to grip a right-side up chassis 17 from the top, virtually the same process is followed except that the rotating frame 47 is inverted and then lowered onto the chassis 17 to latch the rotating frame 47 to the flanges 23 of the side frame members 19 of the chassis 17 from above. The chassis 17 may then be turned over in the same manner as will now be apparent to those skilled in the art.

As thus constructed and operated, the rotator 11 can be used to pick up and rotate the chassis 17 from either above or underneath the frame members 19 regardless of the length of the chassis 17 (e.g., 20 to 40 feet or longer). The rotator 11 can be operated by a single person with all functions performed without requiring the operator to leave the seat. The weight of the chassis 17 is always supported by the fixed, non-sliding latch members during rotation. More specifically, as clearly shown by FIG. 5, the fixed latch members 59, 87 are at the lower portion of the arc of rotation, regardless of whether a chassis 17 is being turned upside-down, or right-side up as will now be apparent to those skilled in the art. Since the slidable latch members 65, 91 are at the top of the arc, the hydraulic cylinders of the latch control means 77, 91 are not subjected to the weight of the chassis 17 at any time during rotation. The rotating frame 47 is preferably U-shaped as clearly shown in FIG. 1. The U-shape of the rotating frame 47 allows clearance around the jack assemblies 27 when stacking and unstacking chassis 17 in a nested arrangement. Under some conditions these jack assemblies 27 can be in such a position as to interfere with picking up or laying down a chassis 17 on top of one which is facing the opposite direction. The U-shape of the rotating frame 17 prevents this from being a hindrance by allowing one "leg" of the U-shaped frame 47 to extend on one side of a jack assembly 27 with the other "leg" extending on the other side of that jack assembly 27.

Figure 11:
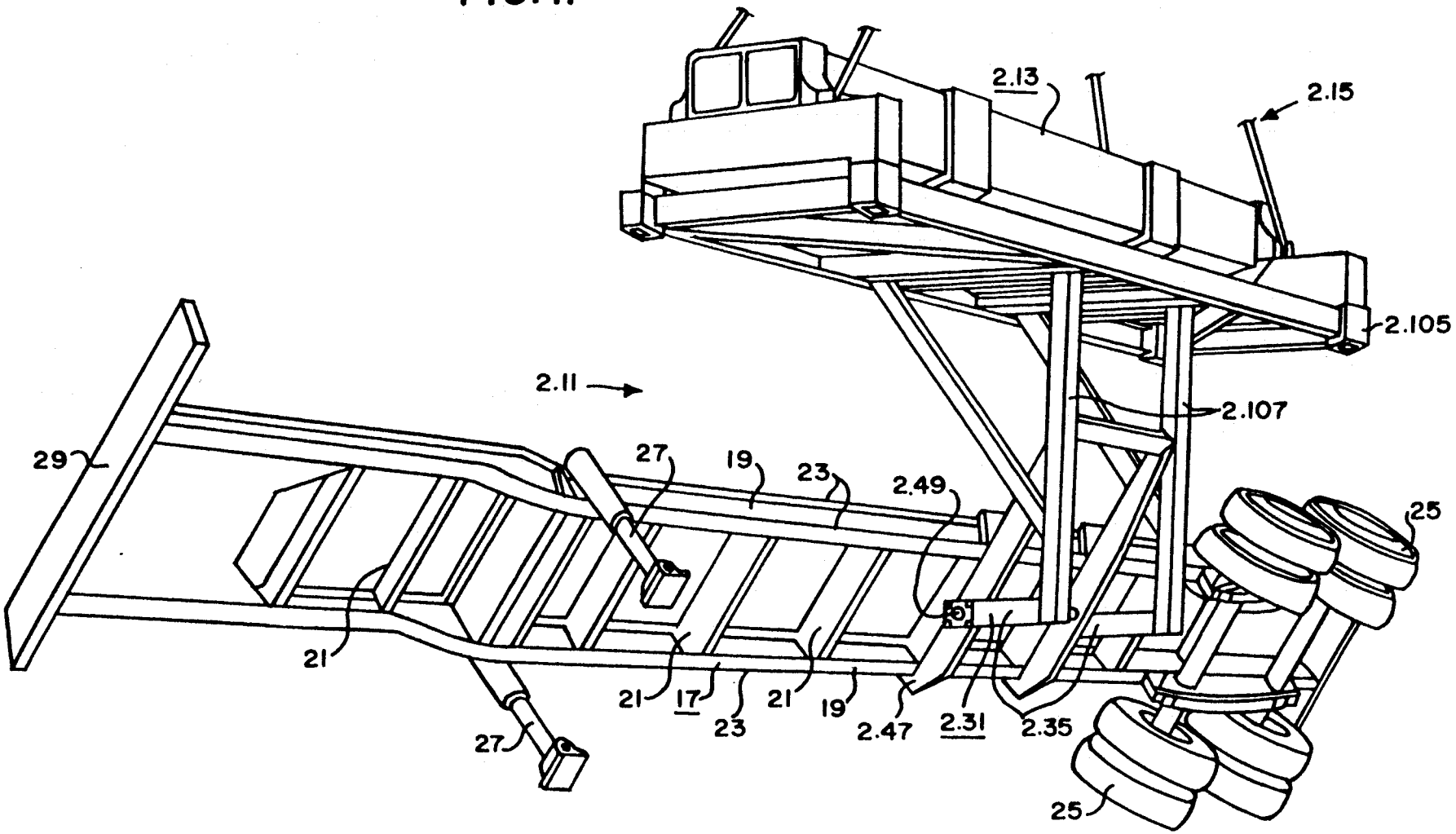
FIG. 11 is a perspective view of a second embodiment of the rotator of the present invention shown in combination with an overhead crane and a trailer chassis.

A second preferred embodiment of the rotator of the present invention is shown in FIG. 11 and identified by the numeral 2.11. The rotator 2.11 is designed to be attached to the lift mechanism 2.13 of a typical overhead crane 2.15 or the like for lifting, transporting, and rotating the wheeled container trailer chassis 17 between a normal, right-side up position and an upside-down position about an axis parallel to the longitudinal axis of the trailer chassis 17.

The rotator 2.11 includes a base frame 2.31 for being attached to the lift mechanism 2.13, a rotating frame 2.47 for being attached to the chassis 17, axle means 2.49 for rotatably attaching the rotating frame 2.47 to the base frame 2.31, and hydraulic means for allowing the operator of the overhead crane 2.15 to secure the chassis 17 to the rotating frame 2.47 and to rotate the rotating frame 2.47 and the chassis 17 between a normal, right-side up position and an upside-down position about an axis parallel to the longitudinal axis of the chassis 17.

The operation and construction of the rotator 2.11 is preferably substantially identical to that of the rotator 11 with the exception of the structure that allows attachment of the base frame 2.31 to the lift mechanism 2.13. More specifically, as clearly shown in FIG. 11, rather than the cross member 45, the base frame 2.31 preferably includes a lift connection frame assembly 2.105 for being attached to the lift mechanism 2.13 as will now be apparent to those skilled in the art, and a pair of substantially upright frame assemblies 2.107 for joining the lift connection frame assembly 2.105 to the second end 2.35 of the base frame 2.31.

Figure 12:
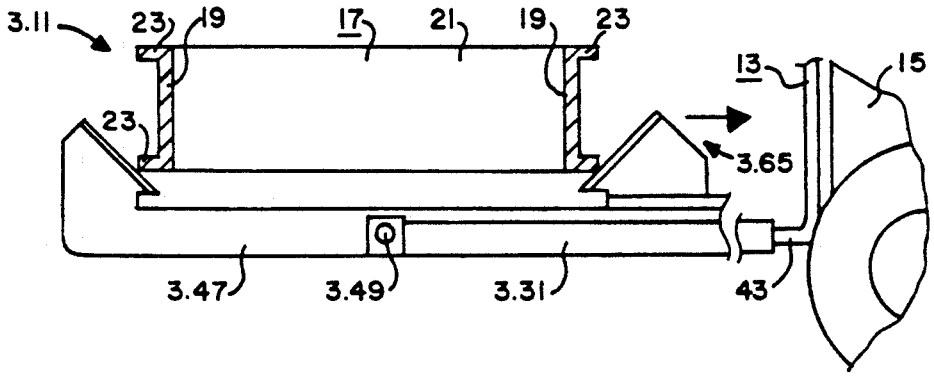
FIG. 12 is a somewhat diagrammatic side elevation view of a third embodiment of the rotator of the present invention with portions thereof broken away for clarity, shown in combination with a portion of a fork lift truck and a section of a trailer chassis.
Figure 13:
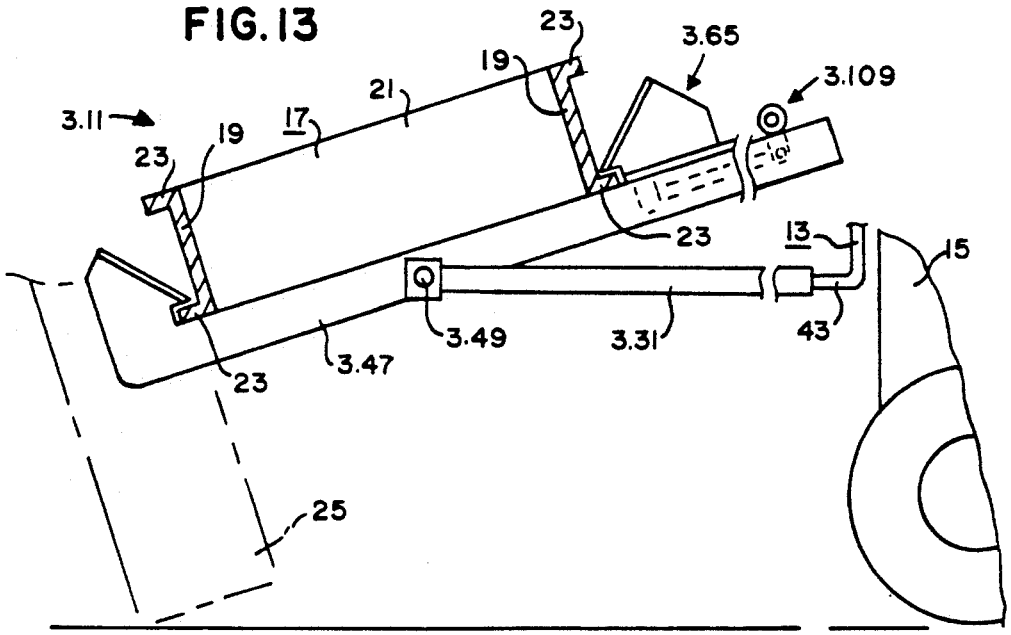
FIG. 13 is a side elevational view similar to FIG. 12 but with both sides of the trailer chassis coupled to the rotator and showing the trailer chassis being rotated.
Figure 14:
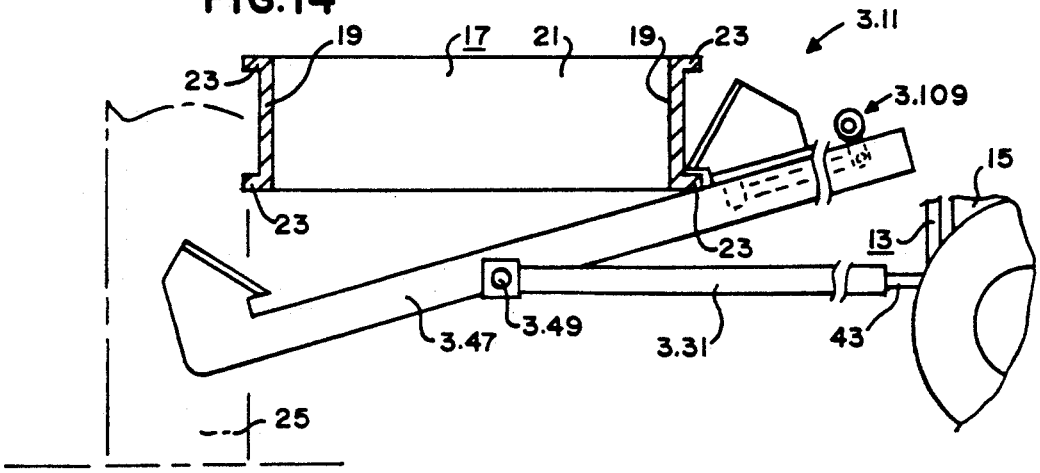
FIG. 14 is a side elevational view similar to FIG. 12 but showing the trailer chassis being disconnected from the rotator.

A third preferred embodiment of the rotator of the present invention is shown in FIGS. 12–14 and identified by the numeral 3.11. The rotator 3.11 is designed to be attached to the lift mechanism 13 of a typical fork lift truck 15 or the like for lifting, transporting, and rotating the wheeled container trailer chassis 17 between a normal, right-side up position and an upside-down position about an axis parallel to the longitudinal axis of the trailer chassis 17.

The rotator 3.11 is preferably substantially identical to the rotator 11 with the exception of the hydraulic means of the rotator 11 for allowing the operator of the fork lift truck 15 to secure the chassis 17 to the rotating frame 47 and to rotate the rotating frame 47 and the chassis 17 between a normal, right-side up position and an upside-down position about an axis parallel to the longitudinal axis of the chassis 17. Thus, the rotator 3.11 includes a base frame 3.31 for being attached to the lift mechanism 13, a rotating frame 3.47 for being attached to the chassis 17, and axle means 3.49 for rotatably attaching the rotating frame 3.47 to the base frame 3.31. However, rather than hydraulic latch control means for moving the latch members to the closed position, the rotator 3.11 includes spring means 3.109 for normally urging the second latch member 3.65 and the fourth latch member (not shown) to the closed positions. The spring means 3.109 preferably includes a mechanical torque tube and linkage assembly designed to assure that the second latch member 3.65 and the fourth latch member will operate simultaneously. The specific design and construction of such a mechanical torque tube and linkage assembly may vary as will now be apparent to those skilled in the art. Preferably, the assembly includes a torque tube rotatably attached to the rotating frame 3.47 by self-aligning bearing assemblies or the like so as to extend substantially between the first and second sides of the rotating frame 3.47, a torque arm welded to each end of the torque tube adjacent each side of the rotating frame 3.47, a push rod attached at one end to each torque arm and at the other end to a respective one of the sliding latch members (i.e., to the third latch member 3.65 o the fourth latch member), and a coil compression spring about each push rod and extending between a reaction plate fixed in place on the rotating frame 3.47 and the respective sliding latch member to thereby normally urge the sliding latch members to the closed positions as will now be apparent to those skilled in the art. More specifically, while latching the rotating frame 3.47 to a chassis 17, the sliding latches will be forced to the open position by the weight of the chassis 17 as indicated in FIG. 12 or by the movement of the fork lift truck 15 as indicated in FIG. 14, thereby compressing both coil springs. The torque tube, torque arms and push rods, together with the sliding latches, move in unison, assuring that both sliding latches move together. Thus, a force against one of the sliding latches which would tend to open the sliding latches and release or drop a chassis 17, by virtue of such a mechanical torque tube and linkage assembly, would require both coil springs to compress, thereby doubling the force required to move the sliding latch members to the opened position, helping to prevent a chassis 17 from being dropped, and keeping the sliding latches closed during all normal operations. For additional safety and to prevent the chassis 17 from becoming accidentally unlatched from the rotator 3.11 such as when an off-balanced chassis 17 is picked up or when the operator hits a foreign object while carrying a chassis 17, a manually operated lock may be provided to mechanically block the sliding latch members, i.e., the second latch member 3.65 and the fourth latch member, from moving to the opened position until the lock is manually opened. The lock may include an over-center, spring-loaded control handle located on one side of the rotating frame 3.47 for allowing an operator to lock or unlock the lock from the ground just prior to or after the rotating frame 3.47 is rotated. Activation of the lock requires a person on the ground to rotate a lever or the like to lock or unlock the latch members. However, in case a chassis 17 is to be stacked or unstacked from a high position, it is not necessary that the person leave the ground. The locking or unlocking is done before and after rotation is complete. It is only during actual rotation that the lock should be engaged.

In addition, rather than hydraulic rotating control means for rotating the rotating frame 3.47 and chassis 17 about the axle means 3.49, the rotator 3.11 relies on inertia to rotate the rotating frame 3.47 about the axle mean 3.49 between the first and second positions.

The operation of the rotator 3.11 is substantially identical to that of the rotator 11, except that rather than activating hydraulic cylinders to latch the chassis 17 to the rotating frame 3.47, the spring means 3.109 will cause the chassis 17 to be automatically locked to the rotating frame 3.47 when the rotating frame 3.47 is brought into proper engagement with the chassis 17. That is, when the rotating frame 3.47 is brought into proper engagement with the chassis 17, the side frame members 19 will engage and push open the sloped cam surfaces of the second latch member 3.65 and the fourth latch member as shown in FIG. 12 and compress the spring means 3.109. Once the flanges 23 pass the sloped cam surfaces, the spring means 3.109 will push the second latch member 3.65 and the fourth latch member toward the fixed latch members to again close the second latch member 3.65 and fourth latch member and secure the chassis 17 to the rotating frame 3.47.

To latch onto an inverted chassis 17, the mast of the fork lift truck 15 is tilted forward, the rotating frame 3.47 is lowered onto the frame of the chassis 17 in a manner to hook the sliding latches to the outer frame rail. The operator then pulls the fork lift truck 15 toward the rear and lowers its forks simultaneously. When the rotating frame 3.47 contacts the inner frame rail of the chassis 17, the fork lift truck 15 is moved forward and the spring means 3.109 will push the sliding latches into proper engagement with the chassis 17 so that the chassis 17 is ready to be lifted and rotated.

To then rotate the chassis 17 once the chassis 17 is secured to the rotating frame 3.47, the operator merely lifts the chassis 17 with the lift mechanism 13 and then pushes the tires of the chassis 17 against the ground or another chassis 17, etc., to cause the rotating frame 3.47 and chassis 17 to rotate about the axle means 3.49 as shown diagrammatically in FIG. 13 and as will now be apparent to those skilled in the art. Inertia will cause the rotating frame 3.47 and chassis 17 to fully invert.

To release an inverted chassis 17 from the rotating frame 3.47 after the chassis 17 has been properly positioned on a support surface (e.g., the ground, another chassis 17, etc.), the operator merely pulls toward the rear slightly with the fork lift truck 15, lifting the forks of the fork lift truck 15 simultaneously a few inches to release the fixed latch members. The operator then moves the rotator frame 3.47 forward slightly to release the sliding latch members.

To release an upright chassis 17 as shown in FIG. 14, the operator merely reverses the directions of these movements.

As thus constructed and operated, the rotator 3.11 allows the rotational function to be carried out by the operators's movement of the fork lift truck, by pushing the chassis 17 against a solid object to impart rotation about the approximate center of gravity of the chassis 17. Rotation of the chassis 17 is thus by manual manipulation of the fork lift truck 15 after the chassis 17 is partially lifted. By lightly pushing the chassis 17 against the ground or other chassis 17, etc., the chassis 17 is caused to rotate about the center of rotation of the rotator 3.11. This rotating operation may be performed very quickly by a fork lift operator alone. No other assistance is required. The chassis 17 may thus be rotated from an upright to an inverted position or vice-versa in the same manner. The chassis 17 may be transported on the rotator 3.11 to the point where it is loaded onto a bundle, etc., in a safe, secure manner since it is latched to the rotator 3.11 during this operation. The spring loaded latch members attach the rotating frame 3.47 to the chassis 17 at four points and permit easy latching and unlatching of the chassis 17 from the rotator 3.11, via operator movements of the fork lift truck, etc. No manual pinning or fastening of the chassis 17 to the rotating frame 3.47 is needed. The weight of the chassis 17 is always supported by the fixed, non-sliding latch members during rotation. More specifically, as clearly shown by FIG. 13, the fixed latch members are at the lower portion of the arc of rotation, regardless of whether a chassis 17 is being turned upside-down, or right-side up as will now be apparent to those skilled in the art. Thus, gravity is used to help prevent the chassis 17 from coming unlatched. Since the sliding latch members are at the top of the arc, neither the spring means nor the lock are subjected to the weight of the chassis 17 at any time during rotation. Rotation of the chassis 17 is about the longitudinal axis of the chassis 17 about or near to the longitudinal center of gravity of the chassis 17, which is located a few inches below the lower flanges 23 of the side frame members 19.

Although the present invention has been described and illustrated with respect to preferred embodiments and preferred uses therefor, it is not to be so limited since modifications and changes can be made therein which are within the full intended scope of the invention.

I claim:

1. A rotator for being attached to a lift mechanism and for rotating a trailer chassis, said trailer chassis having a longitudinal axis and having landing gear legs, said rotator comprising:

a) a base frame for being attached to said lift mechanism;

b) a rotating frame, said rotating frame being U-shaped for providing clearance for said landing gear legs of said trailer chassis;

c) a first latch member fixedly attached to said rotating frame;

d) a second latch member movably attached to said rotating frame a spaced distance from said first latch member for movement toward and away from said first latch member between an opened position away from said first latch member and a closed position toward said first latch member and for coacting with said first latch member to securely attach said trailer chassis to said rotating frame when in said closed position;

e) latch control means for moving said second latch member between said opened and closed positions and for allowing the operator of said lift mechanism to cause said second latch member to move between said opened and closed positions from a location remote from said second latch member; and f) axle means rotatably attaching said rotating frame and said base frame to one another for allowing said rotating frame to rotate between a first position and a second position to rotate said trailer chassis between an upright position and an inverted position about an axis parallel to the longitudinal axis of said trailer chassis.

2. The rotator of claim 1 in which said trailer chassis includes an elongated frame formed by a pair of spaced apart side frame members with each of said side frame members having an upper edge and a lower edge and having an outwardly extending flange at said upper edge and having an outwardly extending flange at said lower edge; in which said first latch member includes a rigid hook-like structure for receiving a portion of only one of said outwardly extending flanges of one of said side frame members of said trailer chassis; in which said second latch member includes a rigid hook-like structure for receiving a portion of only one of said outwardly extending flanges of one of said side frame members of said trailer chassis; and in which is included rotating control means for rotating said rotating frame about said axle means between said first and second positions; said rotating control means including a first hydraulic cylinder having a first end anchored to said rotating frame adjacent said axle means and having a second end anchored to said base frame and including a second hydraulic cylinder having a first end anchored to said rotating frame adjacent said axle means and having a second end anchored to said base frame, said first ends of said first and second hydraulic cylinders being anchored to said rotating frame on opposite sides of the center of said axle means whereby extension of one of said hydraulic cylinders of said rotating control means and contraction of another of said hydraulic cylinders of said rotating control means will cause said rotating frame to rotate approximately 180 degrees about said axle means.

3. The rotator of claim 1 in which is included spring means for urging said second latch member to said closed position.

4. The rotator of claim 1 in which inertia is used to rotate said rotating frame about said axle means between said first and second positions.

5. A rotator for being attached to a lift mechanism and for rotating a trailer chassis having a longitudinal axis between a right-side up position and an upside-down position about an axis parallel to the longitudinal axis of the trailer chassis, said rotator comprising:

a) a base frame for being attached to the lift mechanism; said base frame having a first end, having a second end, having a first side extending between said first and second ends, and having a second side extending between said first and second ends;

b) a rotating frame having a first end, having a second end, having a first side extending between said first and second ends, and having a second side extending between said first and second ends to form a U-shape;

c) a first latch member fixedly attached to said first side of said rotating frame adjacent said first end thereof;

d) a second latch member movably attached to said first side of said rotating frame a spaced distance from said first latch member; said second latch member being movable between an opened position and a closed position for securely clamping the trailer chassis between said first and second latch members when said second latch member is in said closed position;

e) a third latch member fixedly attached to said second side of said rotating frame adjacent said first end thereof;

f) a fourth latch member movably attached to said second side of said rotating frame a spaced distance from said third latch member; said fourth latch member being movable between an opened position and a closed position for securely clamping the trailer chassis between said third and fourth latch members when said fourth latch member is in said closed position;

g) axle means for rotatably attaching said rotating frame and said base frame to one another for allowing said rotating frame to rotate between a first position and a second position;

h) means for mounting said second and fourth latch members to said rotating frame; and i) means for moving said second and fourth latch members between said opened and closed positions and for allowing the operator of said lift mechanism to cause said second and fourth latch members to move between said opened and closed positions from a location remote from said second and fourth latch members.

6. The rotator of claim 5 in which is included rotating control means for rotating said rotating frame about said axle means between said first and second positions; said rotating control means including a first rotating control means extending between said first side of said base frame and said first side of said rotating frame, and a second rotating control means extending between said second side of said base frame and said second side of said rotating frame; said first rotating control means including a first hydraulic cylinder having a first end anchored to a portion of said first side of said rotating frame adjacent said axle means and having a second end anchored to a portion of said first side of said base frame and including a second hydraulic cylinder having a first end anchored to a portion of said first side of said rotating frame adjacent said axle means and having a second end anchored to a portion of said first side of said base frame whereby extension of one of said hydraulic cylinders of said first rotating control means and contraction of another of said hydraulic cylinders of said first rotating control means will cause said rotating frame to rotate; said second rotating control means including a first hydraulic cylinder having a first end anchored to a portion of said second side of said rotating frame adjacent said axle means and having a second end anchored to a portion of said second side of said base frame and including a second hydraulic cylinder having a first end anchored to a portion of said second side of said rotating frame adjacent said axle means and having a second end anchored to a portion of said second side of said base frame whereby extension of one of said hydraulic cylinders of said second rotating control means and contraction of the other of said hydraulic cylinders of said second rotating control means will cause said rotating frame to rotate.

7. The rotator of claim 6 in which said means for moving said second and fourth latch members between said opened and closed positions includes latch control means for moving said second and fourth latch members between said opened and closed positions.

8. The rotator of claim 5 in which is included spring means for urging said second and fourth latch members to said closed positions.

9. The rotator of claim 5 in which inertia is used to rotate said rotating frame about said axle means between said first and second positions.

10. The rotator of claim 5 in which said trailer chassis has landing gear legs, and in which said rotating frame is U-shaped for providing clearance for said landing gear legs of said trailer chassis.

11. A rotator for being attached to a lift mechanism of a fork lift truck and for rotating a trailer chassis having a longitudinal axis between a right-side up position and an upside-down position about an axis parallel to the longitudinal axis of the trailer chassis, said rotator comprising:

a) a base frame having a first end, having a second end, having a first side extending between said first and second ends, and having a second side extending between said first and second ends; said second end of said base frame including means for being attached to the lift mechanism of the fork lift truck;

b) a U-shaped rotating frame having a first end, having a second end, having a first side extending between said first and second ends, and having a second side extending between said first and second ends;

c) a first latch member fixedly attached to said first side of said rotating frame adjacent said first end thereof;

d) a second latch member movably attached to said first side of said rotating frame a spaced distance from said first latch member; said second latch member being movable between an opened position and a closed position for securely clamping the trailer chassis between said first and second latch members when said second latch member is in said closed position;

e) a first hydraulic latch control means for moving said second latch member between said opened and closed positions;

f) a third latch member fixedly attached to said second side of said rotating frame adjacent said first end thereof;

g) a fourth latch member movably attached to said second side of said rotating frame a spaced distance from said third latch member; said fourth latch member being movable between an opened position and a closed position for securely clamping the trailer chassis between said third and fourth latch members when said fourth latch member is in said closed position;

h) a second hydraulic latch control means for moving said fourth latch member between said opened and closed positions;

i) axle means for rotatably attaching said rotating frame and said base frame to one another for allowing said rotating frame to rotate between a first position and a second position; and j) rotating control means for rotating said rotating frame about said axle means between said first and second positions; said rotating control means including a first rotating control means extending between said first side of said base frame and said first side of said rotating frame, and a second rotating control means extending between said second side of said base frame and said second side of said rotating frame; said first rotating control means including a first hydraulic cylinder having a first end anchored to a portion of said first side of said rotating frame adjacent said axle means and having a second end anchored to a portion of said first side of said base frame and including a second hydraulic cylinder having a first end anchored to a portion of said first side of said rotating frame adjacent said axle means and having a second end anchored to a portion of said first side of said base frame whereby extension of one of said hydraulic cylinders of said first rotating control means and contraction of another of said hydraulic cylinders of said first rotating control means will cause said rotating frame to rotate; said second rotating control means including a first hydraulic cylinder having a first end anchored to a portion of said second side of said rotating frame adjacent said axle means and having a second end anchored to a portion of said second side of said base frame and including a second hydraulic cylinder having a first end anchored to a portion of said second side of said rotating frame adjacent said axle means and having a second end anchored to a portion of said second side of said base frame whereby extension of one of said hydraulic cylinders of said second rotating control means and contraction of another of said hydraulic cylinders of said second rotating control means will cause said rotating frame to rotate.

12. A rotator for being attached to a lift mechanism of an overhead crane and for rotating a trailer chassis having a longitudinal axis between a right-side up position and an upside-down position about an axis parallel to the longitudinal axis of the trailer chassis, said rotator comprising:

a) a base frame having a first end, having a second end, having a first side extending between said first and second ends, and having a second side extending between said first and second ends; said second end of said base frame including means for being attached to the lift mechanism of the overhead crane;

b) a U-shaped rotating frame having a first end, having a second end, having a first side extending between said first and second ends, and having a second side extending between said first and second ends;

c) a first latch member fixedly attached to said first side of said rotating frame adjacent said first end thereof;

d) a second latch member movably attached to said first side of said rotating frame a spaced distance from said first latch member; said second latch member being movable between an opened position and a closed position for securely clamping the trailer chassis between said first and second latch members when said second latch member is in said closed position;

e) a first hydraulic latch control means for moving said second latch member between said opened and closed positions;

f) a third latch member fixedly attached to said second side of said rotating frame adjacent said first end thereof;

g) a fourth latch member movably attached to said second side of said rotating frame a spaced distance from said third latch member; said fourth latch member being movable between an opened position and a closed position for securely clamping the trailer chassis between said third and fourth latch members when said fourth latch member is in said closed position;

h) a second hydraulic latch control means for moving said fourth latch member between said opened and closed positions;

i) axle means for rotatably attaching said rotating frame and said base frame to one another for allowing said rotating frame to rotate between a first position and a second position; and j) rotating control means for rotating said rotating frame about said axle means between said first and second positions; said rotating control means including a first rotating control means extending between said first side of said base frame and said first side of said rotating frame, and a second rotating control means extending between said second side of said base frame and said second side of said rotating frame; said first rotating control means including a first hydraulic cylinder having a first end anchored to a portion of said first side of said rotating frame adjacent said axle means and having a second end anchored to a portion of said first side of said base frame and including a second hydraulic cylinder having a first end anchored to a portion of said first side of said rotating frame adjacent said axle means and having a second end anchored to a portion of said first side of said base frame whereby extension of one of said hydraulic cylinders of said first rotating control means and contraction of another of said hydraulic cylinders of said first rotating control means will cause said rotating frame to rotate; said second rotating control means including a first hydraulic cylinder having a first end anchored to a portion of said second side of said rotating frame adjacent said axle means and having a second end anchored to a portion of said second side of said base frame and including a second hydraulic cylinder having a first end anchored to a portion of said second side of said rotating frame adjacent said axle means and having a second end anchored to a portion of said second side of said base frame whereby extension of one of said hydraulic cylinders of said second rotating control means and contraction of another of said hydraulic cylinders of said second rotating control means will cause said rotating frame to rotate.

13. A rotator for being attached to a lift mechanism of a fork lift truck and for rotating a trailer chassis using inertia between a right-side up position and an upside-down position about an axis parallel to a longitudinal axis of the trailer chassis, said rotator comprising:

a) a base frame having a first end, having a second end, having a first side extending between said first and second ends, and having a second side extending between said first and second ends; said second end of said base frame including means for being attached to the lift mechanism of the fork lift truck;

b) a rotating frame having a first end, having a second end, having a first side extending between said first and second ends, and having a second side extending between said first and second ends to form a u-shape;

c) a first latch member fixedly attached to said first side of said rotating frame adjacent said first end thereof;

d) a second latch member movably attached to said first side of said rotating frame a spaced distance from said first latch member; said second latch member being movable between an opened position and a closed position for securely clamping the trailer chassis between said first and second latch members when said second latch member is in said closed position;

e) a third latch member fixedly attached to said second side of said rotating frame adjacent said first end thereof;

f) a fourth latch member movably attached to said second side of said rotating frame a spaced distance from said third latch member; said fourth latch member being movable between an opened position and a closed position for securely clamping the trailer chassis between said third and fourth latch members when said fourth latch member is in said closed position;

g) spring means for moving said second and fourth latch members between said opened and closed positions and for allowing an operator of the fork lift truck to cause said second and fourth latch members to move between said opened and closed positions from a location remote from said second and fourth latch members;

h) axle means rotatably attaching said rotating frame and said base frame to one another for allowing said rotating frame to rotate between a first position and a second position; and i) means for mounting said second and fourth latch members to said rotating frame.

* * * * *